US007827914B2

(12) United States Patent
Fernandez et al.

(10) Patent No.: US 7,827,914 B2
(45) Date of Patent: Nov. 9, 2010

(54) DETERMINING A SPEED OF MEDIA

(75) Inventors: Cesar Fernandez, San Diego, CA (US); David Florez, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1225 days.

(21) Appl. No.: 10/974,897

(22) Filed: Oct. 27, 2004

(65) Prior Publication Data

US 2006/0086275 A1 Apr. 27, 2006

(51) Int. Cl.
*B41F 1/34* (2006.01)

(52) U.S. Cl. ..... 101/485; 101/228; 101/231; 101/486; 400/611; 400/708; 400/709; 400/709.1

(58) Field of Classification Search ..... 101/228, 101/231, 485, 486, DIG. 42; 400/611, 708, 400/709, 709.1, 630
See application file for complete search history.

(56) References Cited

U.S. PATENT DOCUMENTS 4,409,852 A * 10/1983 Suzuki et al. ..... 73/862.392
4,412,876 A 11/1983 Lerner et al.
4,620,888 A 11/1986 Easter et al.
4,680,205 A 7/1987 Lerner et al.
4,926,048 A 5/1990 Lerner et al.
4,945,252 A 7/1990 Lerner et al.
5,138,667 A 8/1992 Roch et al.
5,515,088 A 5/1996 Carpenter et al.
5,543,177 A 8/1996 Morrison et al.
5,803,635 A 9/1998 Austin et al.
5,915,864 A 6/1999 Austin et al.
6,027,820 A 2/2000 O'Hagan et al.
6,082,724 A * 7/2000 Kahlig et al. ..... 270/52.14
6,300,968 B1 10/2001 Kerxhalli et al.
6,378,976 B1 4/2002 Byers et al.
6,438,255 B1 * 8/2002 Lesniak ..... 382/107
6,630,659 B1 * 10/2003 Stridsberg ..... 250/231.13
6,743,314 B2 6/2004 Henry et al.
6,764,563 B2 7/2004 Henry et al.
2004/0075708 A1 4/2004 Arakawa
2005/0031361 A1 * 2/2005 Kobayashi ..... 399/49

FOREIGN PATENT DOCUMENTS

EP 0884195 12/1998
WO WO96/14261 5/1996

OTHER PUBLICATIONS

European Search Report dated Apr. 6, 2006.

* cited by examiner

*Primary Examiner*—Ren Yan
*Assistant Examiner*—Matthew G Marini

(57) ABSTRACT

In one embodiment, a method includes applying at least one invisible mark to media, sensing the at least one invisible mark with separate sensors, and determining a speed of the media from signals of the separate sensors.

35 Claims, 4 Drawing Sheets

DETERMINING A SPEED OF MEDIA

BACKGROUND

Industrial print systems normally comprise conveying means, such as continuous belts, to transport print media to the printer. The speed of the media may be monitored during the print process to help achieve a desired quality of print output. Media speed may be tracked using a mechanical encoder or an optical sensor. However, some mechanical systems may not deliver a desired level of accuracy and the use of the optical sensor may involve placement and then removal of marks, used by the optical sensor, on the print media.

BRIEF DESCRIPTION OF THE DRAWINGS

The disclosed systems and methods can be better understood with reference to the following drawings. The components in the drawings are not necessarily to scale.

DETAILED DESCRIPTION

As is discussed below, the speed of print media can be tracked by marking the media during the print process with invisible marks and later sensing the marks to determine the media speed. As used herein, invisible marks refer to marks that are very difficult to view using the unaided human eye. In some embodiments, a plurality of individual marks are provided on the media and are sensed by separate sensors that are spaced apart by a specified distance. By correlating the signals from the two sensors, the media speed can be determined. Once the media speed has been determined, an emulated encoder signal can be generated that simulates an encoder signal of a mechanical encoder. Because the generated signal is emulated, any print resolution of which the printer is capable can be used to perform printing.

Figure 1:
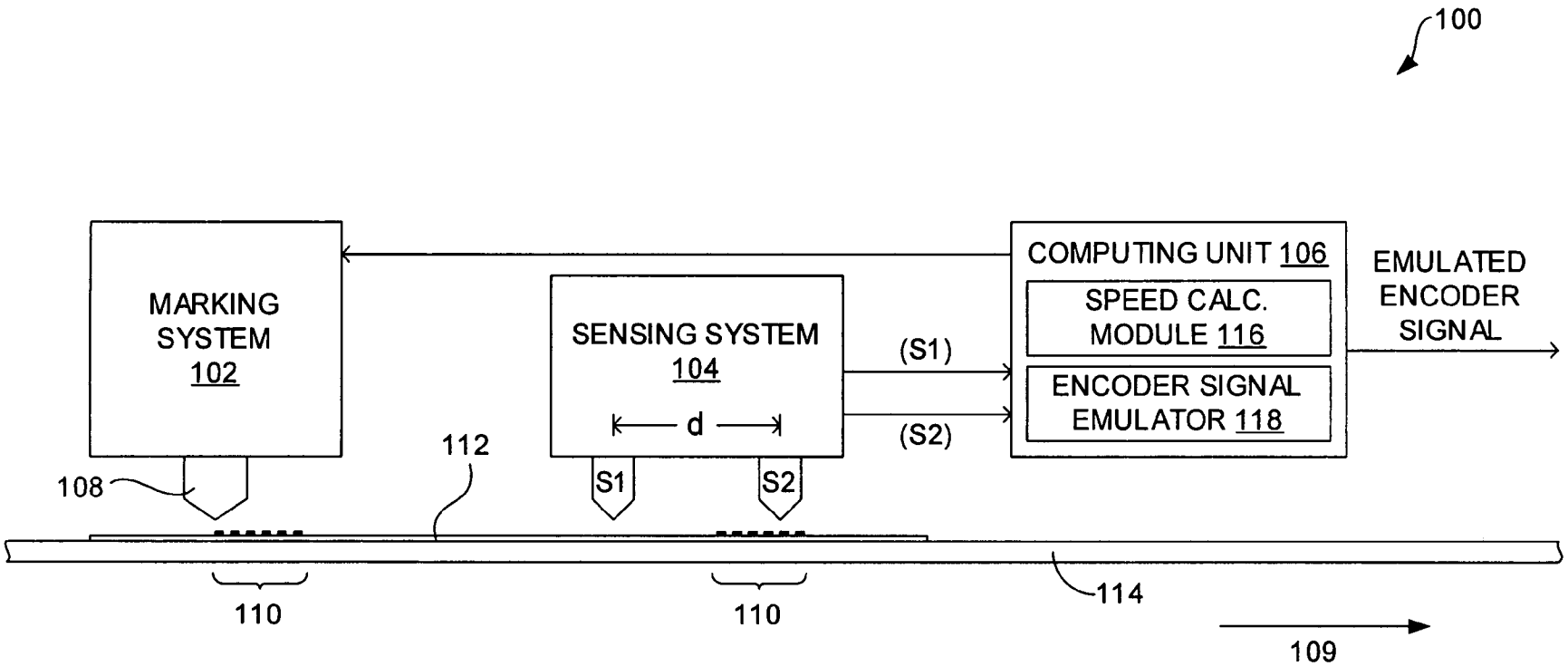
FIG. 1 is a schematic view of an embodiment of a system for measuring a print media speed and generating an encoder signal.

Referring now in more detail to the drawings, in which like numerals indicate corresponding parts throughout the several views, FIG. 1 illustrates an example system 100. As is indicated in that figure, the system 100 includes a marking system 102, a sensing system 104, and a computing unit 106. The marking system 102 comprises a print head 108 that is configured to apply invisible marks 110 to media, such as print media 112 (e.g., paper), that is delivered by a media belt 114 (in the direction of arrow 109) to a printer (not shown). In some embodiments, the marking system 102 comprises an ink printing system that prints invisible marks on the print media 112. For example, the marking system 102 can print ink that can be detected by an optical sensor when illuminated with ultraviolet (UV) or infrared (IR) light (i.e., UV or IR ink). To cite another example, the marking system 102 can print ink that comprises magnetic material that can be detected with a magnetic sensor. In other embodiments, the "print" head 108 comprises a heating device that applies heat to the print media 112 in discrete portions of the print media (i.e., heat "marks") that can be detected with a thermal sensor.

Although particular embodiments for the marking system 102 have been described, those embodiments are cited as examples only. More generally, the marking system 102 is configured to apply marks that cannot be seen with the unaided human eye, but which can be detected with an appropriate sensor. Because no visible marks are applied to the print media 112, no trimming is performed after printing is completed.

Figure 2:
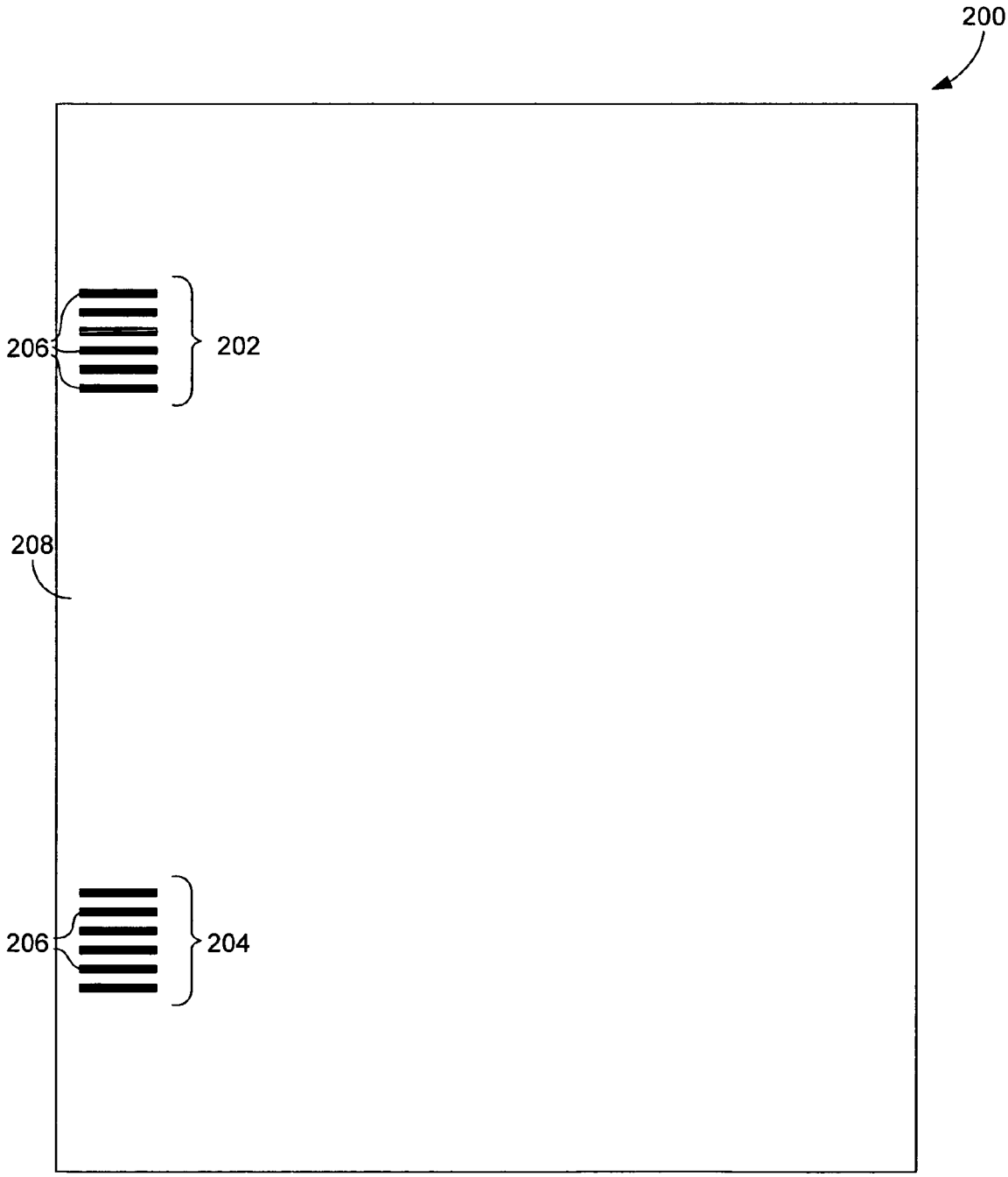
FIG. 2 is a schematic view of an embodiment of a sheet of print media on which various marks have been made.

Irrespective of the type of mark used (i.e., ink, magnetic heat, other), a plurality of marks can be applied to the print media 112. For example, each unit of print media 112 can be marked with one or more groups of marks. Such functionality is illustrated in FIG. 2, which shows an example unit of print media 200 after marking by the marking system 102. As is indicated in FIG. 2, the print media 200 comprises two groups of marks 202 and 204, each comprising a plurality of individual marks 206. Although the marks 206 are represented as visible marks on the print media 200 in FIG. 2, these marks are actually invisible to the unaided human eye. In the illustrated embodiment, the marks 206 each comprise a horizontal line that is provided along an edge 208 of the print media 200. As is described in the following, the provision of a plurality of marks 208 in each group 202, 204 increases the accuracy with which the speed of the media can be determined. The provision of separate groups of marks 202, 204 enables the speed of the media to be determined at two different points in time (e.g., in case the media accelerates or decelerates).

With reference back to FIG. 1, the sensing system 104 is positioned downstream from the marking system 102 and is configured to detect or sense the marks 110 applied to the print media 112 by the marking system as the media travels along the belt 114. In the embodiment of FIG. 1, the sensing system 104 comprises two sensors, S1 and S2, which are spaced from each other a specified distance d. Because the distance d is specified, the speed of the print media 112 can be determined by identifying the time at which a given mark is sensed by the first sensor S1, and then later sensed by the second sensor S2. Specifically, the velocity (v) of the print media 112 can be determined from the relation:

$$v = d/\Delta t \qquad \text{[Equation 1]}$$

$$= d/(t_{S2} - t_{S1})$$

The speed determination is made by the computing unit 106, which comprises a computer or other computing device that may, in one embodiment, include a processor that is adapted to execute instructions or commands stored in memory of the computing unit. Alternative implementations of computing unit 106 may include, for example, an application specific integrated circuit (ASIC). The computing unit 106 receives the signals from the first and second sensors S1, S2, and calculates the speed from those signals using a speed calculation module 116. This process is described in greater detail below in relation to FIGS. 3A and 3B. The computing unit 106 also controls the operation of the marking system 102, and outputs emulated encoder signals that are generated by an encoder signal emulator 118. By way of example, the encoder signals are sent to a printer of an industrial print system (not shown).

The speed calculation module 116 and the encoder signal emulator 118, may, in some embodiments, comprise programs (logic) that perform the functions described above. Such programs can be stored on any computer-readable medium for use by or in connection with any computer-related system or method. In the context of this document, a computer-readable medium is an electronic, magnetic, optical, or other physical device or means that contains or stores commands or executable instructions for use by or in connection with a system or method. These programs can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

As is described above, the speed of the print media 112 is determined by sensing the marks (e.g., marks 206 in FIG. 2) applied to the media by the marking system 102. When a plurality of marks are applied to the print media 112 in close proximity, the speed of the media can be measured. An example of this process will now be discussed in relation to FIGS. 3A and 3B.

Figure 3A:
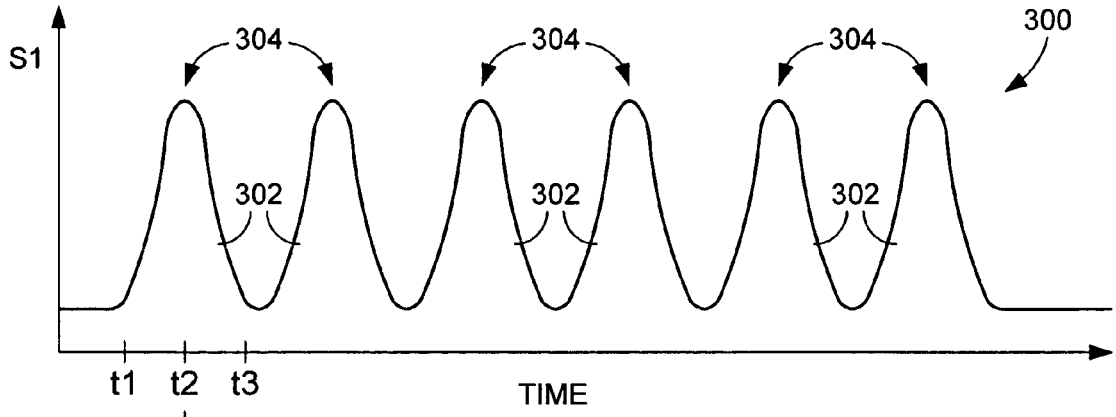
FIG. 3A is a plot of signals versus time for an embodiment of a first sensor shown in FIG. 1.
Figure 3B:
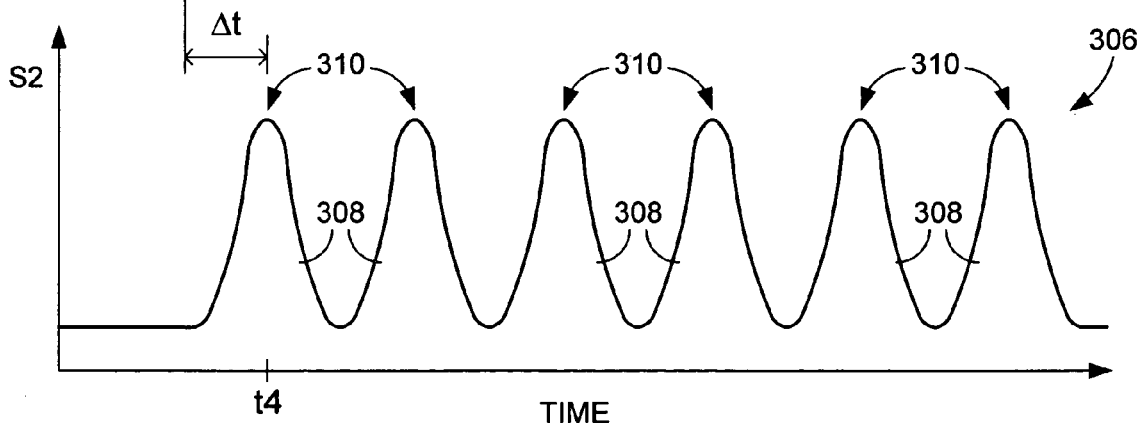
FIG. 3B is a plot of signals versus time for an embodiment of a second sensor shown in FIG. 1.

After a series of marks (e.g., group 202 in FIG. 2) are applied to the print media 112 by the marking system 102, the marks sequentially arrive at the first sensor S1. As each mark (e.g., mark 206) passes under the first sensor 102, the first sensor detects the mark and sends a signal or pulse to the computing unit 106. Therefore, if, in one embodiment, there are six marks in a given series of marks, a pulse train of six pulses is sent to the computing unit 106. FIG. 3A provides an example of such a pulse train 300. As is indicated in that figure, the pulse train 300 includes a plurality of individual pulses 302 that pertain to individual marks. Each pulse 302 has a peak 304 that corresponds to the center of a mark. As is apparent from FIG. 3A, the pulses, in this embodiment, are sinusoidal (as opposed to square) given the nature with which the sensor S1 senses the mark as it travels past. For instance, referring to the first pulse 304 in the train 300, the sensor S1 detects a leading edge of the mark at time t1, the center of the mark at time t2, and the trailing edge of the mark at time t3. In various embodiments, it may be possible that different pulse shapes are produced depending upon the type of sensor used.

Because the second sensor S2 is positioned a short distance (i.e., the distance in FIG. 1) downstream from the first sensor S1, the second sensor detects the marks after the first sensor. Therefore, the second sensor S2 generates its own pulse train 306 that includes pulses 308 that are shifted in time relative to the pulses 302 of the first sensor S1. The difference between the time at which the first sensor S1 detects a given mark and the time the second sensor S2 detects the same mark is the time difference $\Delta t$ that is used in Equation 1 to calculate the speed of the print media 112. One such time difference is identified in FIG. 3B. That time difference ($\Delta t$) is equal to the time between the first peak of pulse train 300 and the first peak of pulse train 306, or ($t_4$-$t_2$).

Although a reasonably accurate measurement of the speed of the media 112 could be obtained from just one mark (i.e., one pulse from each sensor), more accurate results can be obtained when multiple pulses from the first sensor S1 are correlated with multiple pulses from the second sensor S2. In such a process, the shapes of the pulses 302 are matched to the shapes of the pulses 308 so that the peaks 304, 310 can be correlated with greater accuracy and, therefore, the time difference can be likewise determined with greater accuracy. Although any number of pulses can be correlated in this manner, the greater the number of pulses that are correlated, the greater the accuracy with which the time between arrival of the print media 112 at each sensor S1, S2 can be calculated.

Once the speed of the print media 112 has been determined, that speed can be used as input into the encoder signal emulator 118 (FIG. 1), which generates a signal that emulates that of a mechanical encoder. By way of example, the emulator 118 generates a further pulse train that simulates the pulses that would be sent by a mechanical encoder for each mark of an encoder disk that is sensed. The emulated encoder signal can be created so as to enable substantially any print resolution of which the printer is able to be used in the print process without complex interpolation. Therefore, resolutions between the multiples of an encoder disk resolution can be achieved with relative ease.

In addition to increasing the accuracy of the media speed determination and enabling a wider range of print resolutions, the system 100 is contactless and comprises further no moving parts that can wear out or damage the media belt.

Figure 4:
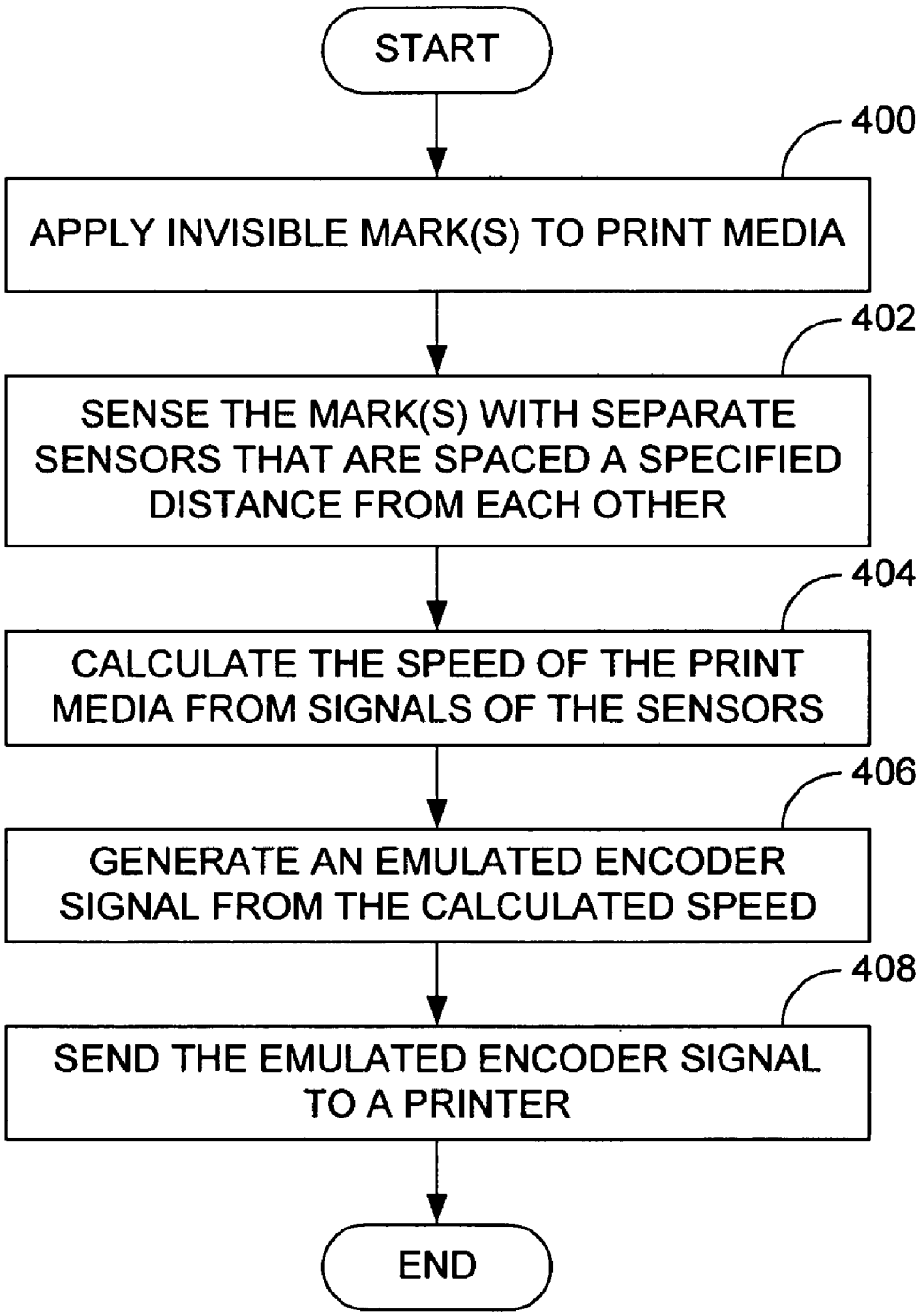
FIG. 4 is a flow diagram that illustrates an embodiment of a method for measuring a print media speed and generating an encoder signal.

In view of the foregoing, a method for measuring a media speed and generating an encoder signal can be described as provided in the flow diagram of FIG. 4. Beginning with block 400 of the figure, the system applies one or more invisible marks to the print media. As is described above, the marks can be applied during the print process. In other words, a separate preprinting process in which the marks are applied to the print media prior to loading the media into the printing apparatus may not be performed. As is further described above, multiple marks may be applied to the print media to increase the accuracy of the speed determination.

Referring next to block 402, the mark(s) are sensed with separate sensors that are spaced a specified distance from each other. For instance, two sensors, one downstream of the other, are used to sense the mark or marks. Once the mark(s) are sensed, the system calculates the speed of the print media from signals of the sensors, as is indicated in block 404. As is described above, the speed calculation comprises matching the shapes of multiple pulses received from the separate sensors using a correlation process to identify the times at which multiple marks arrived at the sensors respectively.

After the speed has been calculated, the system generates an emulated encoder signal from the calculated speed, as indicated in block 406, and then sends that signal to a printer, as indicated in block 408. That signal, can be used to set the print resolution for the printer.

What is claimed is:

1. A method, comprising:

applying at least one invisible mark to media;

sensing the at least one invisible mark with separate sensors;

determining a speed of the media from signals of the separate sensors; and generating an emulated encoder signal from the calculated speed of the media, the emulated encoder signal simulating an encoder signal of a mechanical encoder.

2. The method of claim 1, wherein the applying at least one invisible mark comprises printing a mark on the media that can be detected by an optical sensor when the mark is illuminated with ultraviolet (UV) light.

3. The method of claim 1, wherein the applying at least one invisible mark comprises printing a mark on the media that can be detected by an optical sensor when the mark is illuminated with infrared (IR) light.

4. The method of claim 1, wherein the applying at least one invisible mark comprises printing a mark on the media that comprises magnetic material.

5. The method of claim 1, wherein the applying at least one invisible mark comprises applying a heat mark to the media.

6. The method of claim 1, wherein the applying comprises applying discrete groups of invisible marks to the media and wherein the sensing comprises first sensing the invisible marks of a given discrete group of invisible marks with a first sensor and later sensing the invisible marks of the given discrete group of invisible marks with a second sensor.

7. The method of claim 6, wherein the determining a speed of the media comprises using a correlation process to match the shapes of a first group of pulses received from the first sensor with the shapes of a second group of pulses received from the second sensor, the groups of pulses corresponding to the given discrete group of invisible marks.

8. The method of claim 1, wherein the sensing the at least one invisible mark comprises sensing the at least one invisible mark with two sensors, one of the sensors being positioned downstream from the other sensor.

9. The method of claim 1, wherein the separate sensors are spaced a specified distance from each other and determining the speed includes using the specified distance and the signals.

10. The method of claim 1, wherein the sensing the at least one invisible mark comprises sensing the at least one invisible mark with optical sensors that detect ink illuminated with ultraviolet (UV) light.

11. The method of claim 1, wherein the sensing the at least one invisible mark comprises sensing the at least one invisible mark with optical sensors that detect ink illuminated with infrared (IR) light.

12. The method of claim 1, wherein the sensing the at least one invisible mark comprises sensing the at least one invisible mark with magnetic sensors that detect magnetic ink.

13. The method of claim 1, wherein the sensing the at least one invisible mark comprises sensing the at least one invisible mark with thermal sensors that detect heat marks.

14. The method of claim 1, wherein generating an emulated encoder signal comprises generating a pulse train that simulates pulses that would be sent by a mechanical encoder for each mark of an encoder disk that would be sensed by the mechanical encoder.

15. A system, comprising:

means for applying discrete groups of invisible marks to media;

means for sensing the invisible marks of the discrete groups at separate locations along a direction of travel of the media;

means for determining a speed of the media from signals from the means for sensing; and means for generating an emulated encoder signal from the determined speed, the emulated encoder signal simulating an encoder signal of a mechanical encoder.

16. The system of claim 15, wherein the means for applying discrete groups of invisible marks comprise means for printing discrete groups of marks on the media that can be detected by an optical sensor when the invisible marks are illuminated with ultraviolet (UV) or infrared (IR) light.

17. The system of claim 15, wherein the means for applying discrete groups of invisible marks comprise means for printing discrete groups of marks on the media that comprise magnetic material.

18. The system of claim 15, wherein the means for applying discrete groups of invisible marks comprise means for applying discrete groups of heat marks to the media.

19. The system of claim 15, wherein the means for sensing comprises two separate sensors, one of the sensors being positioned downstream from the other sensor.

20. The system of claim 15, wherein the means for calculating a speed of the media comprises means for using a correlation process to match the shapes of a first group of pulses received from a first sensor with the shapes of a second group of pulses received from a second downstream sensor, the groups of pulses corresponding to a given discrete group of invisible marks.

21. A system, comprising:

a marking system configured to apply invisible marks to media;

a sensing system including two sensors configured to sense the invisible marks on the media to be delivered by the marking system; and a computing unit configured to determine a speed of the media from signals of the sensors and to generate an emulated encoder signal that is used to control a printer of a printing system, the emulated encoder signal simulating an encoder signal of a mechanical encoder, wherein the marking system is configured to apply discrete groups of invisible marks to the media and the computing unit is configured to use a correlation process to match the shapes of a first group of pulses received from a first sensor with the shapes of a second group of pulses received from a second downstream sensor, the groups of pulses corresponding to a given discrete group of invisible marks.

22. The system of claim 21, wherein the marking system is configured to print marks on the media that can be detected by an optical sensor when illuminated with ultraviolet (UV) or infrared (IR) light.

23. The system of claim 21, wherein the marking system is configured to print marks on the media that can be detected by a magnetic sensor.

24. The system of claim 21, wherein the marking system is configured to apply heat marks to the media that can be detected by a thermal sensor.

25. The system of claim 21, wherein the sensors are spaced a specified distance and the computer unit determines the speed using the specified distance and the signals.

26. The system of claim 21, wherein the sensors are optical sensors that detect ink illuminated with ultraviolet (UV) light.

27. The method of claim 21, wherein the sensors are optical sensors that detect ink illuminated with infrared (IR) light.

28. The method of claim 21, wherein the sensors are magnetic sensors that detect magnetic ink.

29. The method of claim 21, wherein the sensors are thermal sensors that detect heat marks.

30. A system, comprising:

first and second sensors separated by a specified distance and configured to generate signals from sensing discrete groups of invisible marks provided on media;

a module configured to determine speed of the media using a correlation process to match the shapes of a first group of pulses received from the first sensor with the shapes of a second group of pulses received from the second sensor, the groups of pulses corresponding to a given discrete group of invisible marks; and a module configured to generate an emulated encoder signal using the speed, the emulated encoder signal simulating an encoder signal of a mechanical encoder.

31. The system of claim 30, further comprising a marking system configured to apply invisible marks to the media in discrete groups.

32. The system of claim 30, wherein the invisible marks are made with ultraviolet (UV) ink and the sensors are optical sensors that detect ink illuminated with UV light.

33. The system of claim 30, wherein the invisible marks are made with infrared (IR) ink and the sensors are optical sensors that detect ink illuminated with IR light.

34. The system of claim 30, wherein the invisible marks are made with magnetic ink and the sensors are magnetic sensors that detect magnetic ink.

35. The system of claim 30, wherein the invisible marks are heat marks and the sensors are thermal sensors that detect heat marks.

* * * * *